United States Patent [19]

Burns

[11] 4,445,909

[45] May 1, 1984

[54] MOTOR FUEL

[75] Inventor: Lyle D. Burns, Bartlesville, Okla.

[73] Assignee: Phillips Petroleum Company, Bartlesville, Okla.

[21] Appl. No.: 200,290

[22] Filed: Oct. 24, 1980

[51] Int. Cl.[3] ..... C10L 1/22

[52] U.S. Cl. ..... 44/72; 252/386

[58] Field of Search ..... 44/72; 252/386

[56] References Cited

U.S. PATENT DOCUMENTS

| | | | |
|---|---|---|---|
| 2,021,088 | 11/1935 | Peuere | 44/72 |
| 2,591,583 | 4/1952 | Moody et al. | 44/72 |
| 2,908,711 | 10/1959 | Halter et al. | 260/534 |
| 3,031,283 | 4/1962 | Becker | 44/72 |
| 3,523,769 | 8/1970 | Tooke | 44/72 |
| 3,526,661 | 9/1970 | Hu | 260/558 |
| 3,676,483 | 7/1972 | Hu | 44/63 |
| 3,770,397 | 11/1973 | Heiba et al. | 44/75 |

OTHER PUBLICATIONS

T. A. Boyd, "Relative Effects of Some Nitrogen Compounds upon Detonation in Engines", Sep. 1924, I & EC, 16, pp. 893–895.

Brown et al., "Mechanism of Aromatic Amine Antiknock Action", Oct. 1955, I & EC, 47, pp. 2141–2146.

*Primary Examiner*—Charles F. Warren

*Assistant Examiner*—Y. Harris-Smith

[57] ABSTRACT

Liquid hydrocarbon fuel compositions are provided containing antiknock quantities of ashless antiknock agents comprising selected primary diamines.

10 Claims, No Drawings

MOTOR FUEL

This invention relates to liquid hydrocarbon fuel compositions having improved antiknock properties. In one of its aspects, this invention relates more particularly to liquid hydrocarbon fuel compositions intended for use in internal combustion engines containing novel and effective ashless antiknock agents. In accordance with a further aspect, this invention relates to liquid hydrocarbon compositions containing antiknock quantities of ashless antiknock agents comprising selected primary diamines.

Various antiknock agents have, heretofore, been suggested and employed for use in liquid hydrocarbon fuels, particularly in fuels employed in internal combustion engines. In such engines, it is highly desirable, from a stand point of economics that combustion of the fuel occurs at relatively high compression ratios. Such high compression ratios concomitantly necessitate the use of fuels having relatively high octane numbers to insure knock-free operation. Many antiknock agents have been proposed and/or used to improve the antiknock properties of hydrocarbon fuels used for internal combustion engines. In general, however, none of these antiknock additives have proved to be satisfactory in effectively raising the octane number of the fuel without also exhibiting other undesirable properties of varying importance. The phase-down of lead in gasoline as required by federal law and the banning of certain additives from use in unleaded gasoline has given impetus to continuation of a systematic study of the antiknock activity of ashless (non-metallic) compounds. The present invention is directed to the use of ashless (non-metallic) additives as antiknock agents for internal combustion fuels.

Accordingly, an object of this invention is to provide ashless hydrocarbon fuel compositions.

Another object of this invention is to provide ashless (non-metallic) antiknock additives for internal combustion engine fuels.

Another object of this invention is to provide hydrocarbon fuel compositions exhibiting improved antiknock properties.

Other objects, aspects as well as the several advantages of the invention will be apparent to those skilled in the art upon reading the specification and the appended claims.

In accordance with the present invention, new and improved liquid hydrocarbon fuel compositions are provided containing an antiknock quantity of ashless (non-metallic) additives comprising selected primary diamines.

The antiknock additives of the invention are known and can be prepared by processes known in the art.

Specific examples of ashless antiknock agents of the invention that can be used in internal combustion engine fuels include 1,4-diaminobutane, 1,3-diaminopropane, and ethylenediamine, and mixtures thereof. These compounds have suitable solubility and volatility characteristics to permit their application as additives for hydrocarbon fuels.

The antiknock additives of the invention are highly suited for use in fuels in view of their ashless characteristics. Naturally, the various compounds of the herein disclosed group do not possess exactly identical effectivenss, and the most advantageous concentration for each such compound will depend to some extent upon the particular compound used. Also, the minimum effective inhibitor concentration can vary somewhat according to the specific nature of the hydrocarbon composition to which it is added.

The amounts of the antiknock agents of the invention added to the hydrcarbon fuels will be sufficient to improve the antiknock properties of the fuel. In general, these novel antiknock additives are employed in amounts from about 0.5 to about 10 percent (5000 to 100,000 parts per million), preferably from about 1 to about 5 percent (10,000 to 50,000 parts per million), by weight of the total weight of the fuel composition.

The water fuels or gasolines into which the invention additives are incorporated are conventional motor fuel distillates boiling in the range of 70°–420° F. (21.1°–216° C.). Gasolines or automotive fuels to which the described additives perform the functions described herein include substantially all grades of gasoline presently being employed in automotive and internal combustion aircraft engines. Generally automotive and aircraft gasolines contain both straight run and cracked stock with or without alkylated hydrocarbons, reformed hydrocarbons, and the like. Such gasolines can be prepared from saturated hydrocarbons, e.g., straight run stocks, alkylation products, and the like, with or without gum inhibitors, detergents, corrosion inhibitors, solvents, emulsifiers, and the like. The motor fuels are unleaded but can contain other conventional fuel additives such as antioxidants and the like.

SPECIFIC EXAMPLE

The primary diamines 1,4-diaminobutane (I), 1,3-diaminopropane (II), and ethylenediamine (III) were dissolved singly at a concentration of 0.1 molar in clear (unleaded) FT-175 gasoline. The following table presents the characteristics of FT-175 gasoline.

CHARACTERISTICS OF TEST GASOLINE

| | |
|---|---|
| Description: | Unleaded Kansas City Premium Pipeline Base Gasoline |
| Designation | FT-175 |
| Reid Vapor Pressure, psi | 7.2 |
| API Gravity @ 60F | 64.4 |
| ASTM Distillation | |
| Vol % Evaporated | Temp., F. |
| IBP | 86 |
| 5 | 115 |
| 10 | 132 |
| 15 | 145 |
| 20 | 157 |
| 30 | 178 |
| 40 | 197 |
| 50 | 213 |
| 60 | 229 |
| 70 | 250 |
| 80 | 286 |
| 90 | 353 |
| 95 | 391 |
| EP | 428 |
| Lead Content, g/gal | 0.005 |
| Sulfur Content, wt % | 0.04 |
| Research Octane Number | 91.5 |
| Motor Octane Number | 83.9 |
| Component | vol % |
| Paraffins | 69.03 |
| Olefins | 15.01 |
| Napthenes | 6.63 |
| Aromatics | 9.33 |
| Average Molecular Weight | 101.3 |
| Atomic Ratio: Hydrogen/Carbon | 2.10 |
| Stoichiometric Air-Fuel Ratio | 14.89 |

Each gasoline was engine tested to determine its Research Octane Number (RON) according to ASTM D 2599-47. The following table presents the increase in RON over the untreated fuel produced by the addition of the selected primary amine compounds.

| Compounds | Conc., wt. % | RON increase |
|---|---|---|
| I | 1.0 | 1.0 |
| II | 1.2 | 1.4 |
| III | Saturated; <0.8 | 0.8 |

The efficacy of the novel ashless antiknock compounds of the present invention for improving the antiknock properties of liquid hydrocarbon fuels will be apparent from the foregoing example and comparative data. It will be understood that the novel ashless antiknock compounds of the present invention can be advantageously employed in any liquid hydrocarbon fuel composition which is suitable for use in a combustion engine regardless of the purpose for which the engine is designed.

I claim:

1. An internal combustion fuel composition consisting essentially of a major proportion of an unleaded motor fuel containing about 1 to about 10 weight percent of an ashless antiknock additive selected from the group consisting of 1,4-di-aminobutane and 1,3-diaminopropane.

2. A composition according to claim 1 wherein the motor fuel is a distillate boiling in the range of about 70° F. to about 420° F. (21.1°–216° C.).

3. An unleaded gasoline composition consisting essentially of an unleaded gasoline and from about 1 to about 10 weight percent of an antiknock additive selected from the group consisting of 1,4-diaminobutane and 1,3-diaminopropane.

4. The composition of claim 3 containing from about 1 to about 5 percent by weight of the antiknock additive.

5. A composition according to claim 3 wherein said additive is 1,4-diaminobutane.

6. A composition according to claim 3 wherein said additive is 1,3-diaminopropane.

7. A method for improving the antiknock properties of a motor fuel which comprises incorporating therein a small but effective amount sufficient to impart reduced knocking tendencies to said motor fuel of at least one ashless antiknock additive which is selected from the group consisting of 1,4-diaminobutane and 1,3-diaminopropane.

8. A method according to claim 7 wherein the motor fuel is unleaded and contains from about 1 to about 10 weight percent of said additive.

9. A method according to claim 7 wherein said motor fuel is unleaded gasoline.

10. A method according to claim 9 wherein said gasoline contains from about 1 to about 5 weight percent of said additive.

* * * * *